United States Patent [19]

Strickland

[11] Patent Number: 5,040,635

[45] Date of Patent: Aug. 20, 1991

[54] MULTISECTION POLE LADDER

[76] Inventor: James C. Strickland, 6256 College Dr., Suffolk, Va. 23435

[21] Appl. No.: 461,946

[22] Filed: Jan. 8, 1990

[51] Int. Cl.[5] ..... E06C 1/10; E06C 1/38

[52] U.S. Cl. ..... 182/100; 182/151; 182/156; 182/178; 182/189

[58] Field of Search ..... 182/100, 189, 164, 156, 182/151, 154; 403/292, 297, 108, 324

[56] References Cited

U.S. PATENT DOCUMENTS

| | | | |
|---|---|---|---|
| 992,785 | 5/1911 | Lloyd | 182/189 |
| 2,148,099 | 2/1939 | Bray | 182/189 |
| 2,473,388 | 6/1949 | Rambo | 403/292 |
| 2,601,926 | 7/1952 | Speaker | 403/328 |
| 3,019,851 | 2/1962 | Doss | 182/189 |
| 3,214,187 | 10/1965 | Fuerst | 403/328 |
| 3,377,966 | 4/1968 | Bates | 403/328 |
| 3,630,314 | 12/1971 | Bamburg | 182/116 |
| 3,961,686 | 6/1976 | Starkey | 182/187 |
| 3,995,714 | 12/1976 | Brookes | 182/100 |
| 4,263,983 | 4/1981 | Norton | 182/100 |
| 4,422,527 | 12/1983 | Schultz et al. | 182/92 |
| 4,674,597 | 6/1987 | Humphrey | 182/92 |

*Primary Examiner*—Reinaldo P. Machado

*Attorney, Agent, or Firm*—Pollock, Vande Sande & Priddy

[57] ABSTRACT

Tree pole ladder which includes first and second detachable sections. Each of the detachable sections pivotally supports laterally extending steps which the foldable from a horizontally extending position for climbing, to a storage position aligned with the pole section. The detachable sections are coupled together by a coupling section which permits the sections to be rapidly connected and detached to a pair of single pole sections which may be easily transported to remote locations.

8 Claims, 3 Drawing Sheets

MULTISECTION POLE LADDER

BACKGROUND OF THE INVENTION

The present invention relates to a portable ladder which permits the climbing of trees or other vertical structures. Specifically, a structure which may be broken down into conveniently-carried pole sections, and then erected to a final ladder assembly is disclosed.

Various devices have been proposed in the past to permit a hunter to climb a tree to erect a hunting stand. These devices permit one to obtain better visibility for game in the immediate area.

Among the devices used in the past for climbing trees include a device shown in U.S. Pat. No. 4,263,983. This patent describes a portable multisection ladder which may be assembled to any height. The various V-shaped members include a male/female plug arrangement on each end. Each section may be strapped to a tree by a plurality of straps having a quick release buckle. This device, as well as other devices shown generally in the art, including U.S. Pat. Nos. 4,674,597, 4,422,527, 3,630,314 and 3,961,686, permit climbing of a tree without defacing it using spikes or other damaging fastening devices.

As these ladder structures are used in remote locations, they must necessarily be simple and easily transportable to avoid overburdening the user with additional structure.

The present invention is an improvement upon the foregoing devices. A tree pole ladder is provided which may be easily broken down into carriable sections.

SUMMARY OF THE INVENTION

It is an object of the invention to provide a portable ladder for climbing trees.

It is a specific object of this invention to provide a multisectioned ladder structure which may be carried in sections and easily erected later for climbing.

It is yet another object of this invention to provide a multisectioned ladder structure which has steps which may be folded into a storage position for carrying and then deployed for climbing vertical structures.

These and other objects of the invention are provided by a pole ladder which includes first and second detachable pole sections. Each of the detachable pole sections supports a laterally-extending step which may be deployed to a substantially horizontal position to permit climbing. Each of the sections are coupled together by a coupling member to erect a full length ladder. The full length ladder may then be strapped to a tree, being held in place by alignment members located at each end of the erected ladder.

Once erected, the steps are deployed into their horizontal position to permit climbing of the tree. When the user departs the area, he merely unstraps the ladder structure, breaks down the two coupled pole sections, and conveniently carries them over his shoulder with the steps fully retracted.

DESCRIPTION OF THE PREFERRED EMBODIMENT

Figure 1:
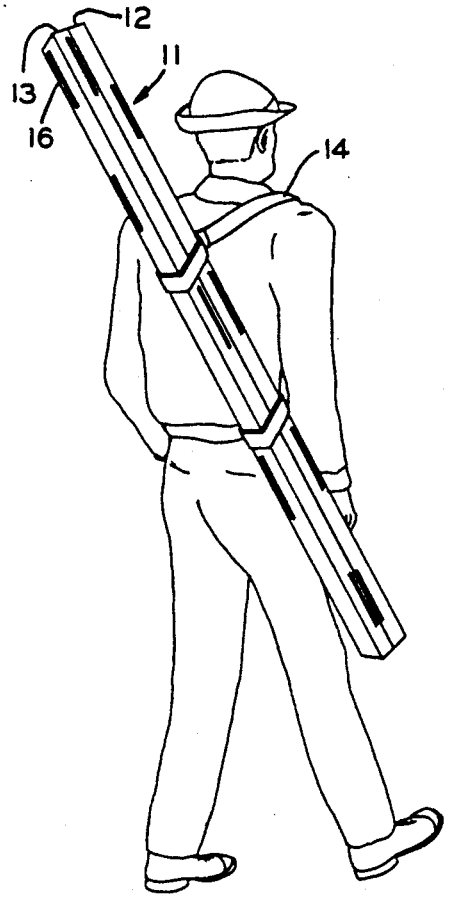
FIG. 1 illustrates the pole ladder in its broken down carrying configuration.

Referring now to FIG. 1, there is shown a two-section pole ladder in accordance with a preferred embodiment of the invention in its disassembled condition. The pole ladder can be seen to include two sections 12 and 13 which may be conveniently carried by a harness 14. The harness 14 may also in some embodiments double as a strap 25 for holding the erected pole ladder fixed to a tree 15.

The illustrated ladder sections of FIG. 1 include no objectionable extending step members. Each of the step members may be conveniently retracted into a slot 16. A coupling member 23 is fully inserted in the end of section 13 flush with the end. Thus, the user need only transport essentially two longitudinal pole sections.

Figure 2:
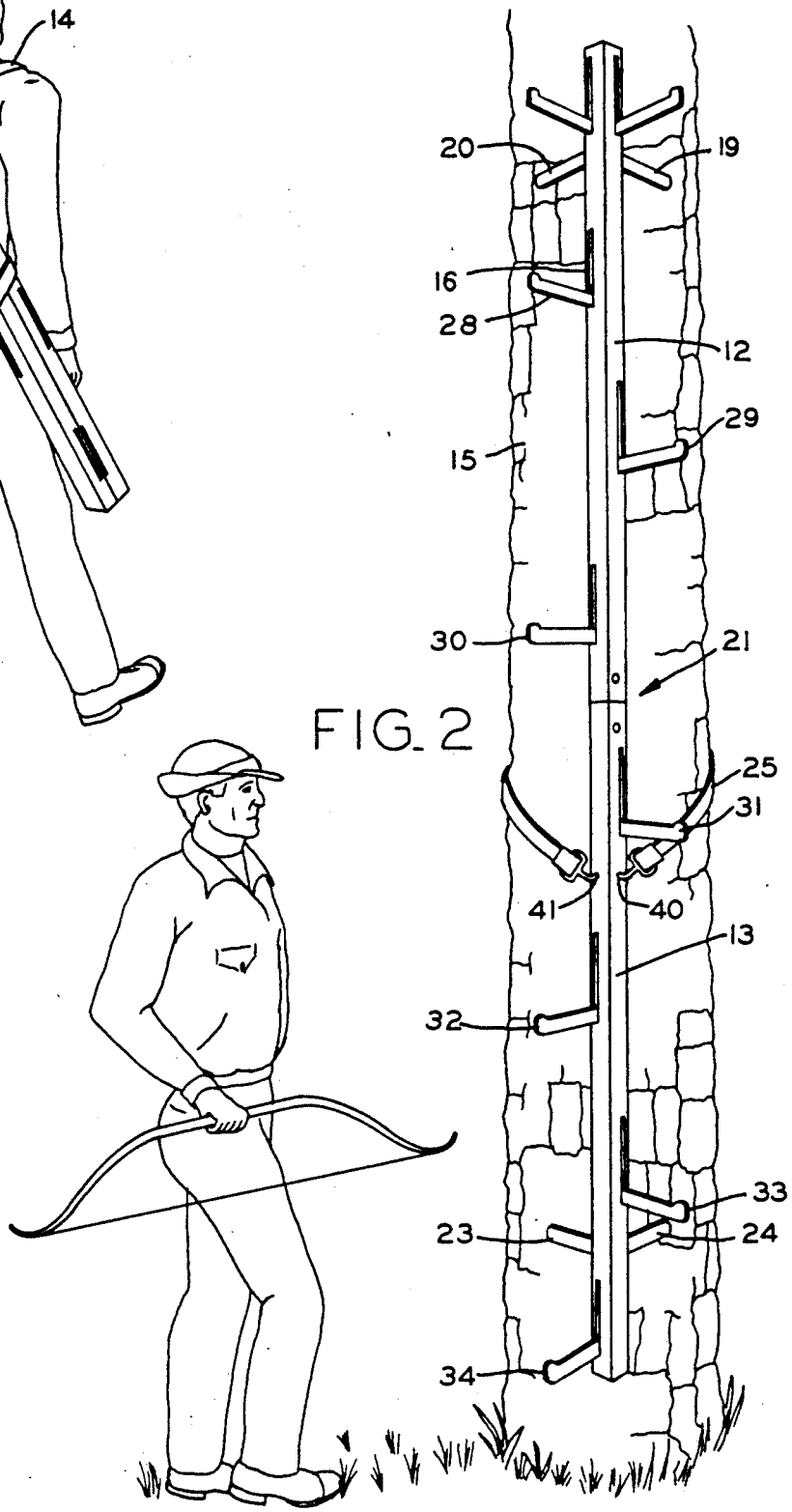
FIG. 2 shows a fully erected pole ladder having multiple sections coupled together.

A fully deployed pole ladder is shown in FIG. 2, in accordance with the preferred embodiment. As can be seen by comparing FIGS. 1 and 2, a full ladder structure having horizontally extending steps may be realized once the two sections are coupled together by a coupling 23. The coupled pole sections are aligned with respect to a tree 15 through first and second pairs 19, 20 and 23, 24 of alignment members which may also be folded into a respective slot of the pole sections 12 and 13. These angularly extending alignment members 19, 20 and 23, 24 tend to maintain the erected pole ladder in a vertical position. The strap 25 and buckle 27 are used to apply tensioning between the ladder section, alignment members 19, 20 and 23, 24 and standing tree 15.

As shown, the plurality of steps 28, 29, 30, 31, 32, 33 and 34 may each be deployed to a horizontal position where they will support the weight of a man climbing the structure as each foot is moved from one to the other step.

Figure 3:
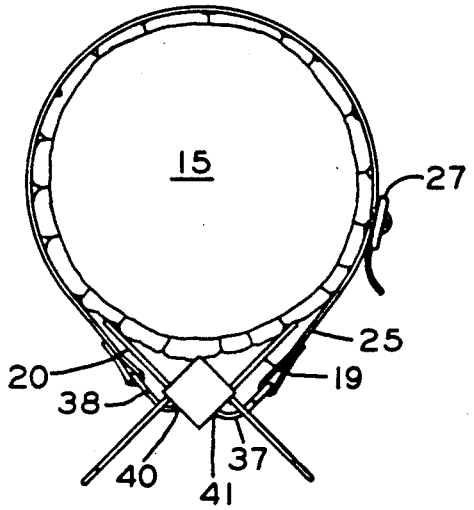
FIG. 3 is a section view showing how the pole ladder structure is maintained in alignment with a tree trunk.

FIG. 3 illustrates how a conventional strap having two hooks 37 and 38 on each end may be hooked into appropriate apertures 40 and 41 in one of the pole sections to tension the alignment members 19, 20, and 23, 24 against the tree. As can be seen, the angle between each of the members 19 and 20 of FIG. 3, and the corresponding angle between members 23 and 24 will align the connected pole sections with the tree 15.

Figure 4:
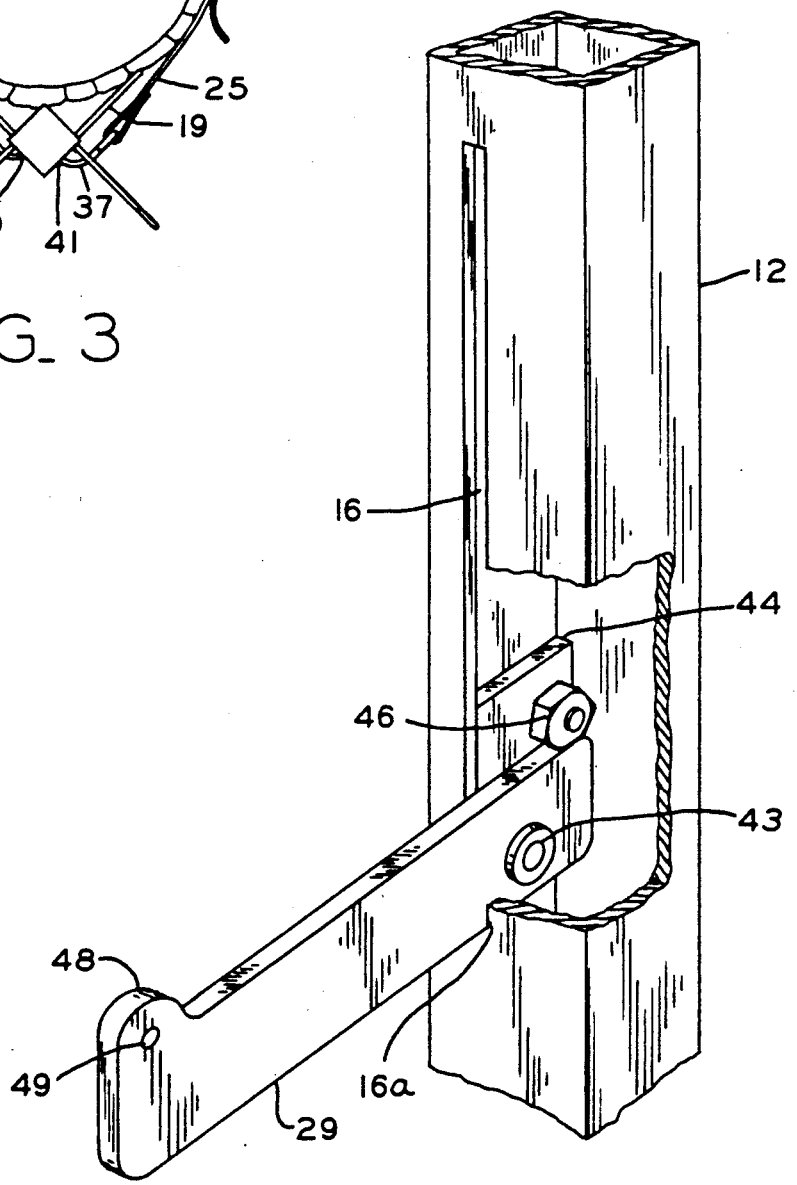
FIG. 4 is a cutaway portion of a pole section illustrating the connection of each step to the pole section.

FIG. 4 shows a view of the step 29 in greater detail as it is connected to each of the pole sections 12 and 13. The step 29 includes at its end an abutment 48 to assist in preventing the user's foot from sliding off the end of the step. At the opposite end, step 29 is held via a bolt 43 or other fastener to permit rotation of the step 29 vertically, away from a stop 46 provided by a conventional nut threaded to a bolt. The stop 46 and bolt 43 are held on a base 44 which may itself be fastened to the inside wall of the respective pole section 12. The longitudinal slot 16 will receive the end 48 of the step 29 when the step is rotated in its non-use, transportable configuration. Although not shown, it is easy to implement a clip or other retaining means to hold the end 48 within the slot 16 during transporting of the pole ladder.

This clip may be of the type having facing wings connected together by a spring member. The wings may be displaced by the end 48 of step 29. A counter sunk hole 49 is retained by the clip wings when the end 48 is received in the clip. Once deployed, the step 29 will rest on the bottom of slot 16. During use, the user applies his foot to the step and the stop 46 and bottom of the slot 16*a* will retain the step 29 in its deployed configuration.

Figure 5:
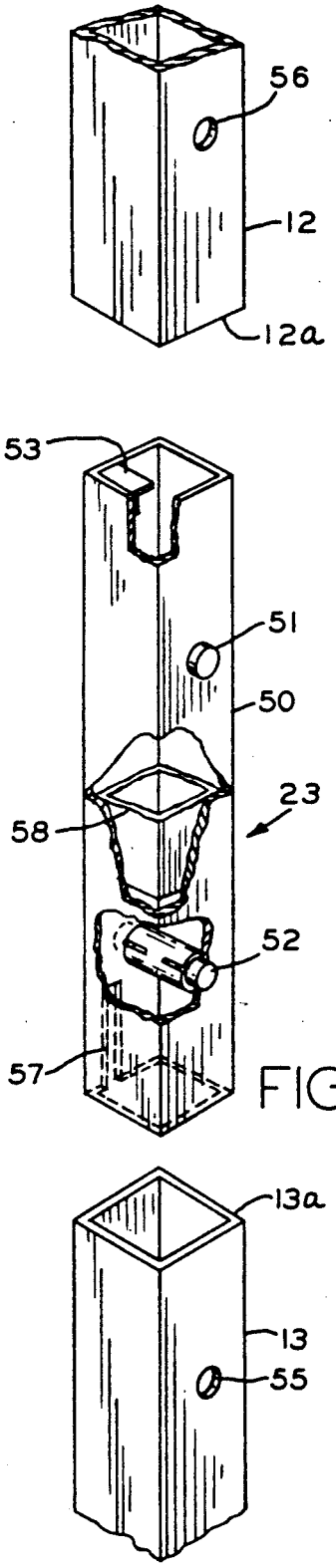
FIG. 5 illustrates the coupling member used to couple pole sections together.

Details on the coupling member 21 may be seen in FIG. 5. Referring now to FIG. 5, there is shown the coupling member 21, which includes a tubular member 50 having a rectangular cross-section, which is dimensioned to receive the conforming end of the pole sections 12 and 13. These conforming ends have an inner dimension which will receive the outer dimensions of the coupling member 21. Thus, each end 12*a* and 13*a* of the pole sections may be slid over the corresponding ends of the coupling member 21. A pair of retractable pin latches 51 and 52 are shown which may be retracted along an axis perpendicular to the axis of the pole sections. During insertion of each end of the pole section, 12*a* and 13*a* to the respective ends of the coupling member 21, the pins 51 and 52 will initially be forced inside the coupling member 21. When these pins are in alignment with holes 55 and 56, they will enter the holes, maintaining rigid the coupling member 23 to each of the pole sections 12 and 13. Also shown in this Figure is a reinforcing element 58 located within the coupling member 21. This may be material of similar cross-section which may be inserted within the coupling member 23 and held by suitable fastening means, such as rivets, through the reinforcing element 58 and coupling member 21.

Shown also on coupling member 21 a small lip 53 which will permit the user to remove this section by pulling thereon once the upper section 12 has been separated. On the opposite end of coupling member 21 is a slot 57. During transportation, the coupling member can be pushed down inside the pole section 13 until lip 53 is flush with the top of the section 13. Slot 57 permits the coupling member 23 to slide over the first step 31 of pole section 13. Pin latch 51 can engage hole 55. During assembly of the tree pole ladder, lip 53 will permit the coupling member 21 to be pulled from its storage position to an assembled position where pin latch 52 engages hole 55.

Figure 6:
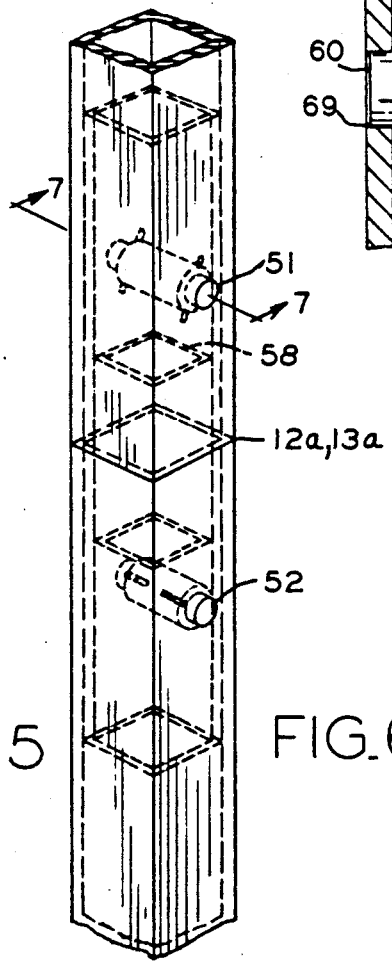
FIG. 6 demonstrates pole sections 12 and 13 connected together by a coupling member 23.
Figure 7:
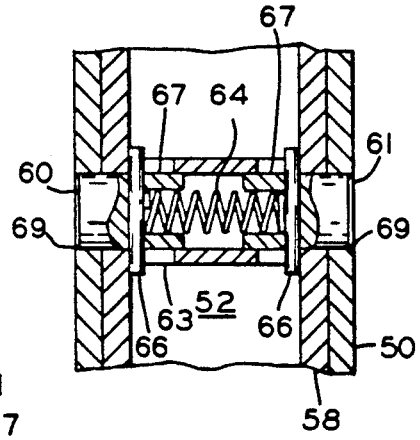
FIG. 7 shows a cross-section of the coupling member fastening means for holding each pole section to the coupling member.

FIG. 6 illustrates a fully coupled ladder wherein ends 12*a* and 13*a* abut each other because of the rigid coupling provided by coupling member 21. The fastening means 51 and 52 include at opposite ends thereof a pair of horizontally displaceable pin members, shown more particularly in FIG. 7. This pair of pin members are 60 and 61, and they may be moved horizontally, permitting the sections 12, 13 to be separated from the coupling member. These pin structures are known in the mechanical fastening art and slide within a tubular chamber 63 against the action of a spring 64. Each of the two pins has a recess 67 for receiving a spring 64 which forces the pins into their extended position. The tubular chamber 63 includes a pair of flanges 66 which face the reinforcing member 58 of the coupling member 21. During manufacture, the pin members 60, 61 are compressed, permitting the fastening means 51,52 to be inserted inside the reinforcing element 58. These pins expand into corresponding holes 69 in the reinforcing element 58 and tubular member 50, thus holding the fastening means 51, 52 in place. These pins will again be compressed to abut the surface of tubular member 50 when the tubular member is initially pushed into the end of a pole section. The pins expand into each pair of holes 55, 56, fixing the coupling to the pole sections.

As can be appreciated from the foregoing Figures, the device is not only strong, but lends itself to rapid deployment without tedious assembly requirements. Further, there is no defacing of trees and relative safety using the pole ladder device.

Those skilled in the art will recognize yet other embodiments of the invention as described more particularly by the claims which follow.

What is claimed is:

1. A pole ladder comprising:

first and second pole sections, said sections having a length suitable for carrying;

coupling means for detachably coupling said pole sections together to form a single pole which may be fastened to a standing structure;

a plurality of laterally extending steps having one end pivotally connected to said pole sections, positionable from a first position aligned with a connected pole section to a second position substantially perpendicular to said pole section, providing supports which permit climbing said standing structure;

each of said laterally extending steps having one end extending through a slot in said pole, and connected through said pole section wall by a fastening means which permits said steps to pivot;

first and second pairs of laterally extending positioning members, said pairs of positioning members located on opposite ends of said single pole, maintaining said single pole structure in rigid alignment with said standing structure, said positioning members being pivotal from a position aligned with a pole section to a deployed position for maintaining said single pole positioned with respect to said standing structure; and a strap member or retaining said single pole aligned with said standing structure.

2. The pole ladder of claim 1 wherein said coupling means comprises:

a tubular member having outside dimensions substantially the same as an inner dimension of said pole sections, permitting first and second ends of said pole sections to receive opposite ends of said tubular member; and, first and second fastening means for maintaining said tubular member axially fixed with respect to each pole section.

3. The pole ladder of claim 2 wherein said first and second fastening means comprise first and second spring loaded pins which retract along an axis perpendicular to said pole section major axis during insertion of said opposite ends in said pole sections, and expands into an adjacent hole of said pole sections.

4. A tree pole ladder comprising:

first and second pole sections, each of said pole sections supporting laterally extending steps, each step being supported at one end to a pole section through a slot in said pole section in a horizontal position, said steps having an end pivotally connected to a wall of said section whereby said steps are movable from said horizontal position to a vertical position aligned with said pole section;

a coupling member for detachably connecting each of said pole sections together at one end thereof, said coupling member and sections having congruent shapes and dimensions, permitting sliding engagement of one inside the other along a common axis, and having first and second fastening means for restraining axial movement of said sections; with respect to said coupling member;

first and second pairs of alignment members located at opposite ends of said pole sections, each pair extending from a respective section at an angle to each other; and, a strap means for surrounding a tree and said pole section, forcing said alignment members into rigid contact with said tree.

5. The tree pole ladder of claim 4 wherein said coupling member is a tubular member which slides inside of each pole section, and supports first and second pairs of spring loaded pin members for movement in a direction perpendicular to the axis of said section, and which expand to engage a hole located in each section to maintain said section and coupling member in rigid alignment.

6. The tree pole ladder of claim 5 wherein a lip portion is attached to said coupling member to permit removal from said pole section.

7. The pole ladder of claim 5 wherein the unconnected end of said laterally extending steps includes an abutment portion.

8. The tree pole ladder of claim 5 wherein said laterally extending steps are maintained in a vertical position aligned with said pole section by means of a friction clip mounted on the inside thereof.

* * * * *